US005105904A

United States Patent [19]

Olsen

[11] Patent Number: 5,105,904

[45] Date of Patent: Apr. 21, 1992

[54] CERUMEN TRAP FOR HEARING AIDS

[75] Inventor: Jorgen M. Olsen, Hillerod, Denmark

[73] Assignee: Topholm & Westermann ApS, Denmark

[21] Appl. No.: 635,131

[22] PCT Filed: Aug. 11, 1989

[86] PCT No.: PCT/EP89/00891

§ 371 Date: Dec. 26, 1990

§ 102(e) Date: Dec. 26, 1990

[87] PCT Pub. No.: WO90/02471

PCT Pub. Date: Mar. 8, 1990

[30] Foreign Application Priority Data

Aug. 26, 1988 [DE] Fed. Rep. of Germany ..... 3828934

[51] Int. Cl.[5] ..... H04R 25/00

[52] U.S. Cl. ..... 181/128; 181/129; 181/135

[58] Field of Search ..... 181/128, 130, 135, 129; 381/68.6, 69; 128/864, 867

[56] References Cited

U.S. PATENT DOCUMENTS 4,553,627 11/1985 Gastmeier et al. ..... 381/68.6

FOREIGN PATENT DOCUMENTS 1259951 2/1968 Fed. Rep. of Germany .

*Primary Examiner*—Brian W. Brown
*Assistant Examiner*—Khanh Dang
*Attorney, Agent, or Firm*—Sughrue, Mion, Zinn, Macpeak & Seas

[57] ABSTRACT

A cerumen trap for hearing aids comprises a sound channel and a plurality of perforations arranged in a stellate pattern around the sound channel which connect the sound outlet of an earpiece with the sound channel. A cylindrical component (1) with a connecting piece (3) which surrounds the sound channel can be inserted in the hearing aid. A number of angle brackets (4) with locking detents (5) are arranged on the periphery of the component (1). The sound outlet opening (2) can be closed off from the exterior by a cap (7) which has a locking groove (8) on the inner wall and which engages with the locking detents (5).

4 Claims, 3 Drawing Sheets

CERUMEN TRAP FOR HEARING AIDS

The invention relates to a cerumen trap for hearing aids in accordance with the general definition of patent claim 1.

Such cerumen traps are already known. For example, DE - B 1 259 951 describes a hearing aid with a protective device to prevent ingress of cerumen into the inside of the hearing aid. For this purpose, a U-shaped component is fitted in the sound outlet channel of the hearing device which possesses two lateral sound perforations. The component possesses a base into which the lug of a cover which covers the sound outlet to the outside is engaged. On its inner side, the cover possesses four mutually offset webs which form the sound outlet of the device in conjunction with the perforations. In this arrangement, cerumen can still penetrate into the sound outlets at the side. If the cerumen pressure becomes too great, the cover is pressed onto the elastic body of the hearing aid to such an extent that the sound outlet is closed off.

The task of the invention is to create a cerumen trap of the type mentioned at the start where ingress of cerumen is prevented with a high degree of reliability, whereby closing of the sound outlet at a high cerumen pressure is avoided, while the still necessary cleaning of the cerumen trap is facilitated.

This task on which the invention is based is solved in accordance with the characteristics of patent claim 1.

Refer to the other claims for additional characteristics of the invention.

The invention will now be explained in more detail on the basis of an example realization in conjunction with the enclosed figures.

Figure 1:
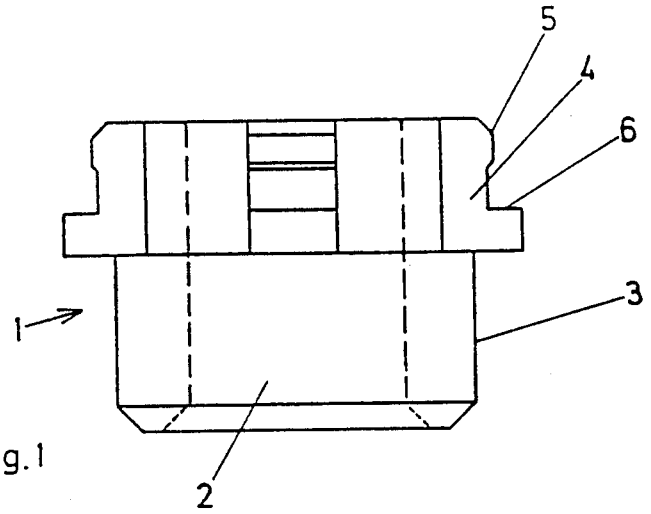
Figure 2:
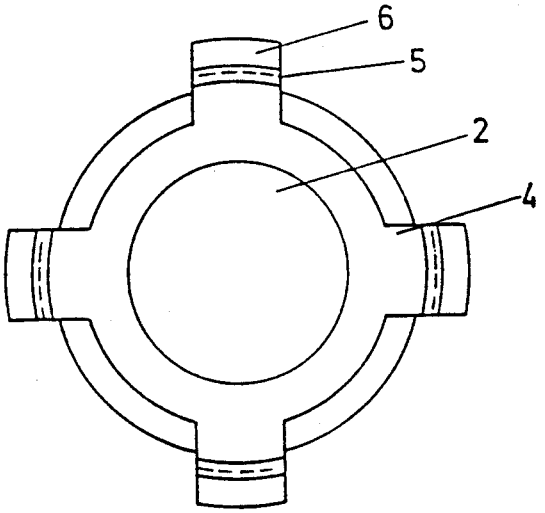
Figure 3:
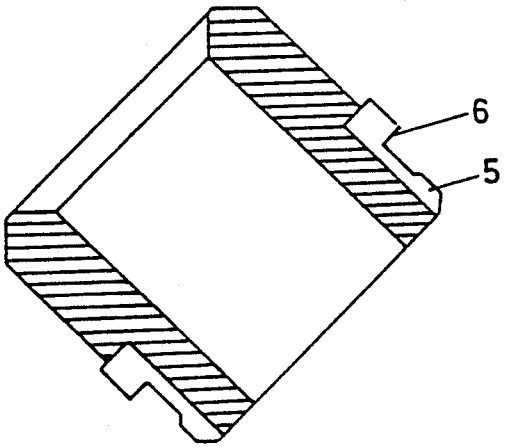
Figure 4:
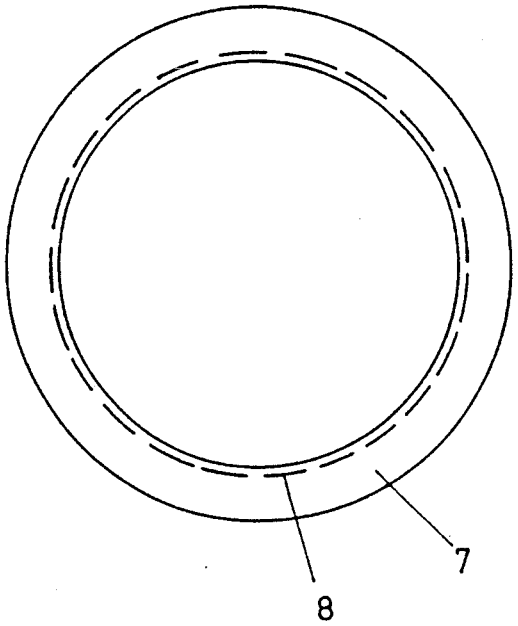
Figure 5:
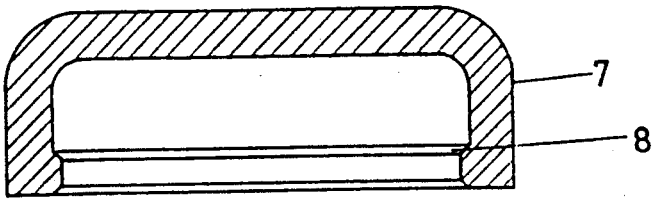

The figures show:

FIG. 1 a highly magnified schematic side depiction of the cylindrical component for a cerumen trap;

FIG. 2 a top view of FIG. 1;

FIG. 3 a section view of FIG. 1;

FIG. 4 a cap, seen from above,

FIG. 5 a section view of the cap shown in FIG. 4 and

Figure 6A:
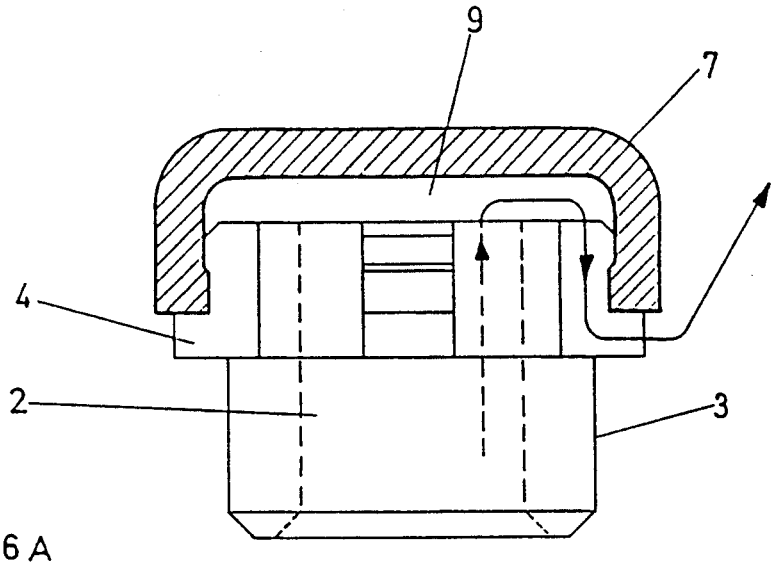
Figure 6B:
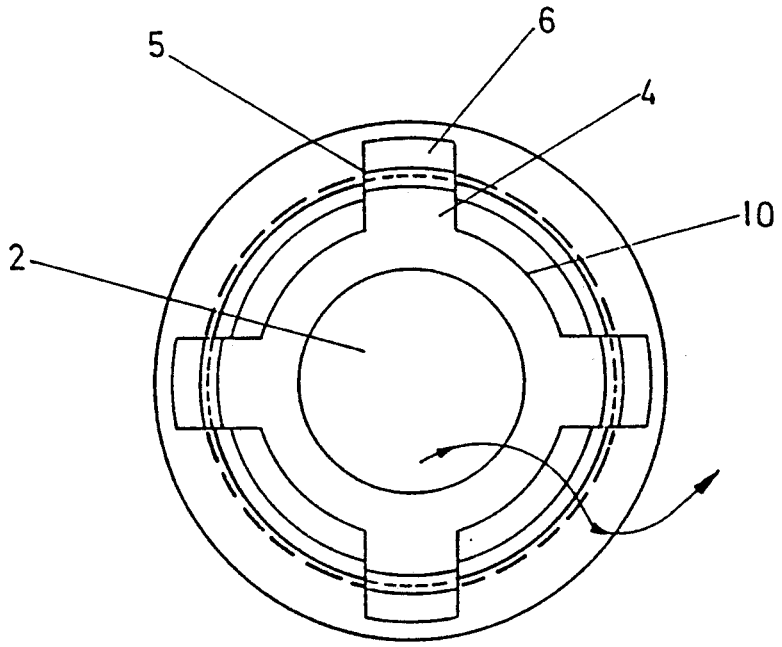

FIG. 6A and 6B the whole cerumen trap in two different views.

The cerumen trap shown in the figures is shown in extremely magnified form. In reality, it possesses an overall diameter of just under 4 mm.

FIG. 1 shows the cylindrical component 1 which can be fitted in a hearing aid or otoplastic device. The cylindrical component possesses an approximately 1.2 mm long connection piece 3 at one of its ends. Of course, these dimensions must not be seen as restrictive in any way.

As can be clearly seen from FIG. 1 in conjunction with FIG. 2, the component 1 possesses several, e.g. four, angle pieces or angle brackets for 4 adjoining the connection piece. Of course, there may be also only 3 or more than 4 of these. These angle pieces are arranged uniformly around the periphery of component 1.

The angle pieces possess locking noses or locking detents 5 at their top end, while a horizontal base section 6 is provided at the bottom end whose importance will be explained below.

FIG. 3 shows a section through this component 1.

The cap 7 shown in FIGS. 4 and 5 can be fitted on this component. For this purpose, the cap 7 possesses a preferably, but, not necessarily, circular all-round locking groove 8 on its internal vertical surface for this purpose with the radially projecting locking detents 5 fitting into the locking groove 8.

The new cerumen trap is shown in a partially sectional side view and in a top view in FIGS. 6A and 6B. It is possible to clearly see that a hollow cavity 9 exists between the top edge of component 1 and the bottom side of the cap 7. The sound outlet path is clearly shown by the arrows drawn in both figures.

If the distances between the individual angle pieces 4 and the size of the hollow cavity 9 are chosen appropriately, it is possible to achieve a desired resonance behavior in the hearing device outlet.

In addition, it is possible to see that the size of the hollow cavity 9 can be varied to a small extent by appropriately choosing the dimensions of the angle pieces and locking noses or the location of the locking groove in the cap 7.

Furthermore, it is evident that the ingress of cerumen is reliably prevented in this new arrangement by the side walls of the cap 7 projecting over the base parts 6 of the angle pieces.

This cerumen trap is extremely easy to clean, since the cap can be easily removed. Nevertheless, the cap is normally seated sufficiently tightly on the cylindrical component, because the locking nose 4 engaged in the locking groove 8 of cap 7 achieves a clamping effect in conjunction with the bearing contact of the cap edge on the base part 6 of the angle pieces 4.

The invention can also be realized by a mechanical reversal. Component 1 would then be smooth on its surface facing the auditory canal and would have a locking groove on its external surface. The cap 7 would then possess a number of locking noses in conjunction with an identical number of spacer pieces on its inner wall. These would then also not just prevent the cap from being inserted too deeply but would also exert a clamping force.

I claim:

1. In a cerumen trap for hearing aids having a sound outlet channel, said cerumen trap comprising a component (1) insertable in the sound outlet channel, a cap (7) fitted on said component and covering an axial sound outlet opening (2) of the trap and said trap comprising several sound passages, the improvement wherein said component (1) is cylindrical and includes a connecting piece (3) surrounding the axial sound outlet opening (2), a number of circumferentially spaced angle brackets, with radially projecting bracket locking detents (5) and base sections (6) projecting radially outwards of the outer periphery thereof, said cap (7) covering the sound outlet opening (2) of component (1) includes a locking groove (8) on a vertical inner peripheral wall thereof engageably receiving the locking detents (5) of the angle brackets (4) and said detents seating on base sections of said angle brackets with brackets (10) forming between the angle brackets and the cap (7) and constituting said sound passages.

2. Cerumen trap for hearing aids in accordance with claim 1, wherein the locking detents (5) are arranged at the top end of the angle brackets (4) and said cap (7) rests on the base sections (6) and forms a hollow cavity (9) together with component (1).

3. Cerumen trap in accordance with claim 2, wherein the cap fitted on the cylindrical component forms a resonance chamber together with said hollow cavity acting in conjunction with the sound passages (10) between the angle brackets (4).

4. Cerumen trap in accordance with claim 3, characterized in that the angle brackets (4) are arranged at equal distances from each other around the periphery of the component (1).

* * * * *